US006834916B2

(12) United States Patent
Volkman et al.

(10) Patent No.: US 6,834,916 B2
(45) Date of Patent: Dec. 28, 2004

(54) GARDENING STOOL

(75) Inventors: Cheryl Volkman, Circle Pines, MN (US); Dianne Goodwin, St. Paul, MN (US); Sherry Rovig, Duluth, MN (US)

(73) Assignee: White Pine Concepts, LLC, Circle Pines, MN (US)

( * ) Notice: Subject to any disclaimer, the term of this patent is extended or adjusted under 35 U.S.C. 154(b) by 0 days.

(21) Appl. No.: 09/904,183

(22) Filed: Jul. 12, 2001

(65) Prior Publication Data

US 2003/0205924 A1 Nov. 6, 2003

Related U.S. Application Data

(63) Continuation-in-part of application No. 29/141,794, filed on May 11, 2001, now Pat. No. Des. 454,706, and a continuation-in-part of application No. 29/141,803, filed on May 11, 2001, now Pat. No. Des. 454,438.

(51) Int. Cl.[7] ..... A47C 3/03

(52) U.S. Cl. ..... 297/270.1; 297/338

(58) Field of Search ..... 297/4, 338, 344.18, 297/183.1, 188.08, 258.1, 175, 270.1, 370, 271.5, 461; 248/158, 398, 152

(56) References Cited

U.S. PATENT DOCUMENTS

| | | | | |
|---|---|---|---|---|
| 938,219 A | * | 10/1909 | Crumb | 248/398 |
| 1,976,170 A | * | 10/1934 | Hoover et al. | 182/230 |
| 2,038,806 A | | 4/1936 | Sellar | |
| 2,049,539 A | | 8/1936 | Greenwood | |
| 2,998,358 A | * | 8/1961 | Nakayama | 472/134 |
| 3,312,437 A | | 4/1967 | Barth | |
| 4,025,107 A | * | 5/1977 | Chippa | 108/116 |
| 4,084,273 A | * | 4/1978 | Haynes | 297/270.1 |
| 4,099,771 A | * | 7/1978 | Mathews | 248/158 |
| 4,101,163 A | * | 7/1978 | Morin | 297/16.1 |
| 4,130,263 A | | 12/1978 | Roericht | |
| 4,218,093 A | | 8/1980 | Gertz | |
| 5,112,103 A | * | 5/1992 | Downer | 297/270.1 |
| 5,337,427 A | * | 8/1994 | Pagano et al. | 128/845 |
| 5,586,804 A | | 12/1996 | Burroughs | |
| 5,733,011 A | * | 3/1998 | Young et al. | 297/423.11 |
| 5,887,944 A | | 3/1999 | Boost | |
| 5,887,951 A | * | 3/1999 | Willingham | 297/258.1 |
| 5,891,546 A | * | 4/1999 | Sherman | 15/217 |
| 5,909,925 A | | 6/1999 | Glockl | |
| 6,062,638 A | * | 5/2000 | Ferguson | 297/4 |
| 6,709,052 B2 | * | 3/2004 | Jalkanen | 297/202 |

FOREIGN PATENT DOCUMENTS

| | | |
|---|---|---|
| DE | 3201335 A1 | 7/1983 |
| GB | 865245 | 4/1961 |
| WO | WO 90/08490 | 8/1990 |

* cited by examiner

*Primary Examiner*—Peter M. Cuomo
*Assistant Examiner*—Stephanie Harris
(74) *Attorney, Agent, or Firm*—Merchant & Gould P.C.

(57) ABSTRACT

A gardening stool that allows for tilting and pivoting is provided. The gardening stool has an elongated base connected to a seat by a post. The elongated base is convex and is tapered towards the front for pivoting. The base may include a flattened region located toward the rear of the post for stability. The base may further include compartments for holding tools.

31 Claims, 8 Drawing Sheets

GARDENING STOOL

This application claims the benefit of and is a continuation-in-part of U.S. application Ser. No. 29/141,794, now U.S. Pat. No. D454,706 and U.S. application Ser. No. 29/141,803, now U.S. Pat. No. D454,438, both filed on May 11, 2001.

BACKGROUND

1. Field of the Invention

This invention is directed to a stool for use in a garden and more particularly to a stool that provides a user support while the user tilts and pivots in a forward or a forward and sideways direction.

2. Description of the Prior Art

Various types of stools are well known, some of which are modified to suit a particular use. Many of these stools are symmetrical to allow the user to sit on them facing any direction, and some of these stools have rounded bottoms to allow for some degree of tilting.

U.S. Pat. No. 5,112,103 shows a symmetrical stool with a seat attached by a support column to a rounded bottom. The bottom has projections that allow the stool to be rocked slightly on soft ground, but does not allow rocking on a hard surface. A tool holder is attached to the support column. The bottom of the stool is a continuous curve.

U.S. Pat. No. 2,049,539 shows a symmetrical stool with a flat top connected to a base by four legs. The base has a flat region in the center and curves upward to a downturned rim. The upward curve allows for some tilting, and the downturned rim prevents the stool from tiling too far. Tools can be placed between the legs.

U.S. Pat. No. 3,312,437 shows a symmetrical stool with a round scat and base connected by a post. In one embodiment, the base has a flat center and is weighted for stability.

While these stools allow for some tilting or rocking motion, and at least the first two can be used in the garden, they have some drawbacks. The first two stools have a limited tilting or rocking ability, and the third stool relies on a weighted base for stability, making it inconvenient for moving from place to place in a garden.

SUMMARY OF THE INVENTION

Accordingly, one embodiment of the present invention is a stool with an elongated base attached to a seat with a post. The base has a front and a back corresponding to a front and back of the stool, respectively. The base is elongated from the back to the front along a longitudinal axis, and tapers from a first width at the back to a second, narrower width at the front. The base has a convex bottom surface extending around a perimeter of the base, and the front of the base has a rounded nose extending upwards.

In another embodiment, the stool includes an elongated base with a substantially flattened region located rearward of the post. A seat is attached to the base by a post.

In a further embodiment, the base of the stool has two opposing sides with convex curvatures. The sides converge and meet at a nose, and the base has a rounded outer perimeter to allow the stool to pivot when in a forward-leaning position. The top surface of the base is upwardly concave and can include one or more storage compartment. In one embodiment, the bottom surface of the base at the nose has a non-slip surface. The bottom surface of the base at the nose can also include discrete protrusions.

In another embodiment, the stool seat of the stool has a front and back corresponding to the front and back of the stool, respectively, and first and second sides adjacent the front and back. The seat can be elongated from the first and second sides so that the seat is elongated transverse with respect to the longitudinal axis of the base. The stool can also include handles located at the first and second sides of the seat.

Accordingly a method for gardening utilitzes the stool embodiments. In one method the seat positions the user in an upright seated position wherein the user may roll forward and tilt from side to side. In another method the seat supports a kneeling user when performing gardening tasks.

DESCRIPTION OF THE PREFERRED EMBODIMENT

The invention will now be described by reference to the accompanying drawings. The illustrated embodiments and description are provided only for exemplary purposes to facilitate comprehension of the invention and should not be construed to limit the scope of the invention.

Figures 6, 7:
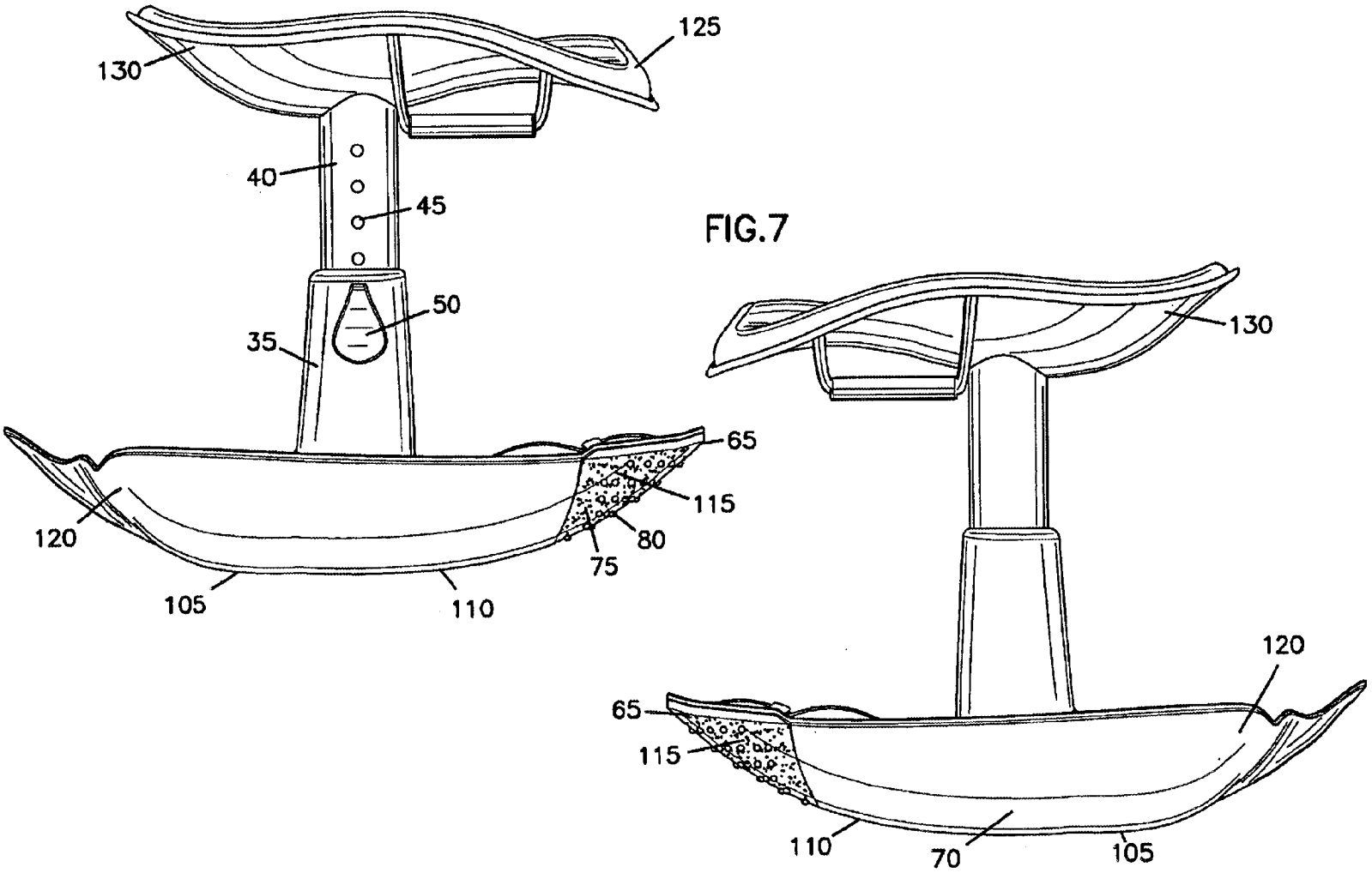
FIG. 6 is a right side elevational view of the gardening stool of FIG. 1.
FIG. 7 is a left side elevational view of the gardening stool of FIG. 1.
Figure 8:
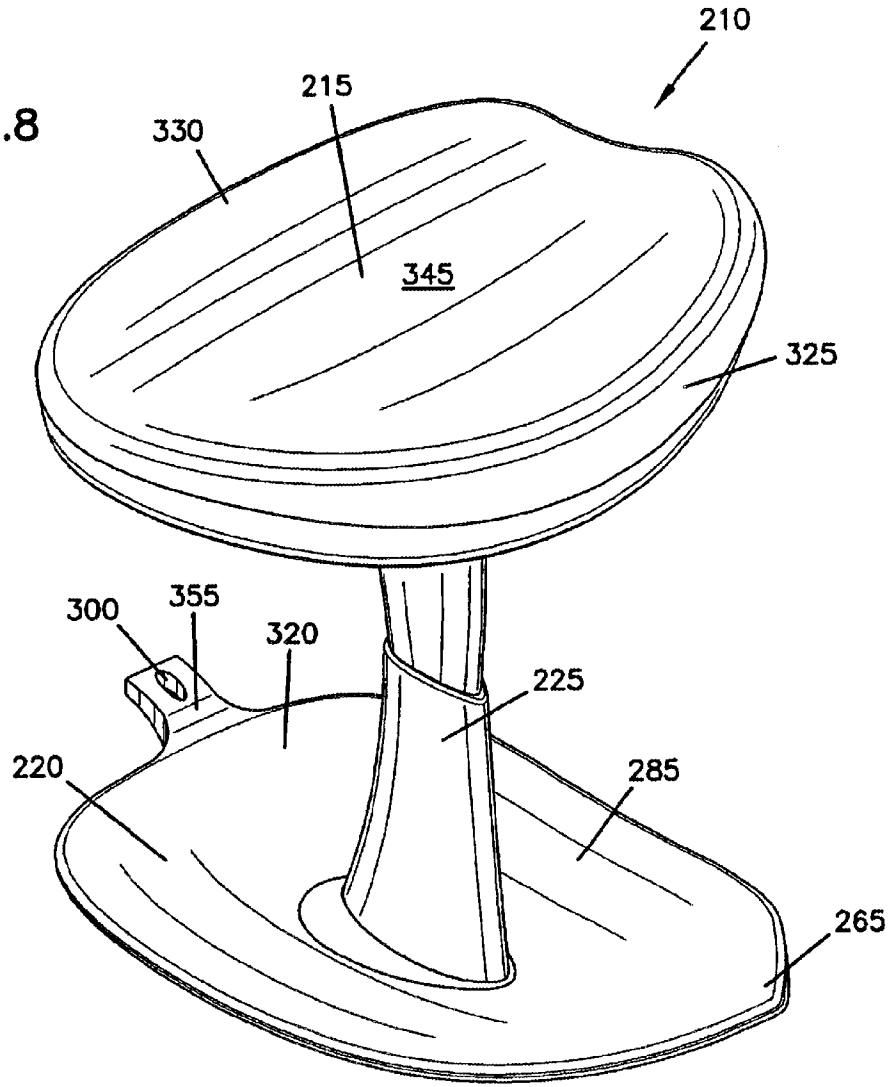
FIG. 8 is a top front perspective view of another embodiment of a gardening stool of the invention.
Figure 10:
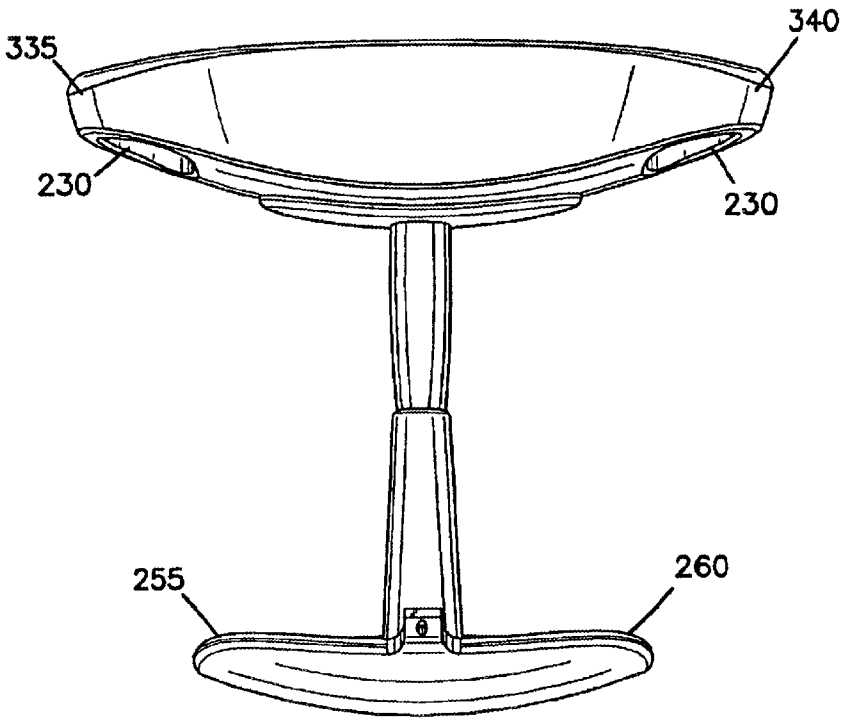
FIG. 10 is a rear elevational view of the gardening stool of FIG. 8.

The invention relates generally to a stool used for gardening. In one embodiment, shown in FIGS. 1–7, the stool 10 includes a seat 15 attached to a base 20 by a post 25. In the illustrated embodiment, the post 25 connecting the seat 15 and base 20 has two parts and is adjustable in height. As shown in FIG. 6, the post 25 has a lower section 35 and an upper section 40. The height of the seat is adjusted by raising or lowering the upper section 40 of the post 40 and locking it in place by fixing an adjustment lever 50 in one of several adjustment holes 45 in the upper section 40 of the post. The post 25 can be any shape or size that provides support for the seat 15 and a means of attaching the seat 15 to the base 20. Additionally, the post 25 can be adjusted by other means including hydraulics, a threaded connection to the seat 15 or base 20, or any other means of raising or lowering a weight-bearing surface.

Figure 5:
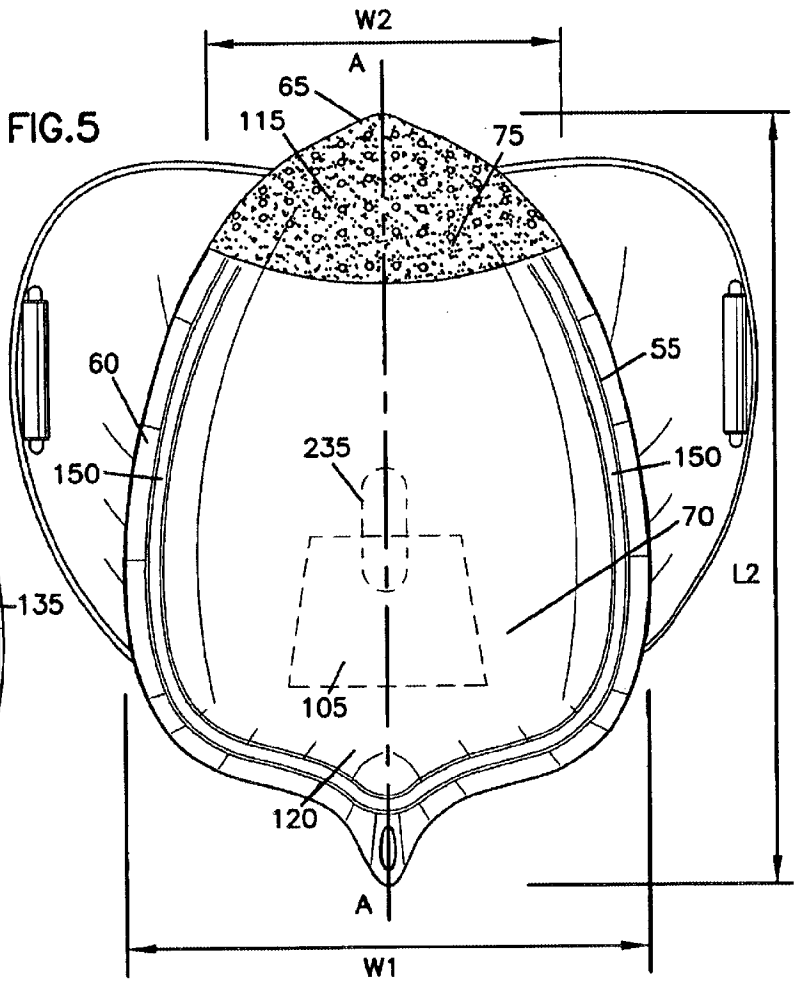
FIG. 5 is a bottom plan view of the gardening stool of FIG. 1.
Figure 4:
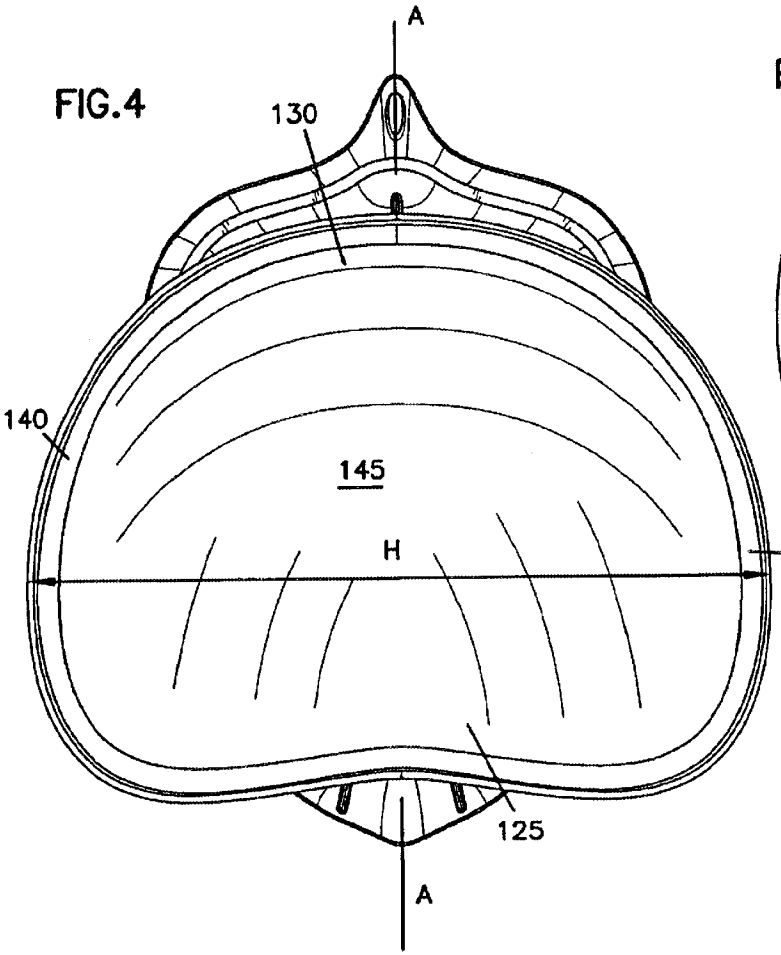
FIG. 4 is a top plan view of the gardening stool of FIG. 1.

The base 20 of the stool has a front end 15 and a back end 120 corresponding to a front and a back of the stool, respectively. The back end 120 of the base is positioned opposite the front end 115 of the base. A first side 55 and a second side 60 extend from the front end 115 to the back end 130 of the base. As shown in FIG. 5, the base 20 is elongated from the front end 115 to the back end 120 along a longitudinal axis A—A and has a length L2. The base 20 tapers from a first width W1 adjacent the back end 120 to a second, narrower width W2 adjacent the front end 115. In the preferred embodiment, the ratio of the widest width W1 of the base 20 to the length L2 of the base 20 is typically at least 2:3.

The base 20 further comprises a bottom surface 70 and an upper surface 85. The bottom surface 70 defines a first longitudinal convex shape extending from the front end 115 to the back end 120 (see FIG. 6). The bottom surface 70 also defines a second transverse convex shape extending from the first side 55 to the second side 60 (see FIG. 1). The first curvature is longitudinal in that it curves or cups along the longitudinal axis A—A of the base. The second curvature is transverse in that it curves or cups perpendicular to the longitudinal axis A—A of the base. The first convex curvature is generally less arcuate or convex than the second convex curvature. The first and second convex curvatures of the base 70 are configured such that user may tilt, pivot, or roll the stool in a forward direction while at the same time lean or tip the stool toward any side direction. The first and second sides 55, 60 may also include a concave region 150 transitioned within the second convex curvature and extending longitudinally. In general, the bottom surface 70 comprises an overall convex configuration that defines the perimeter of the base.

Figure 1:
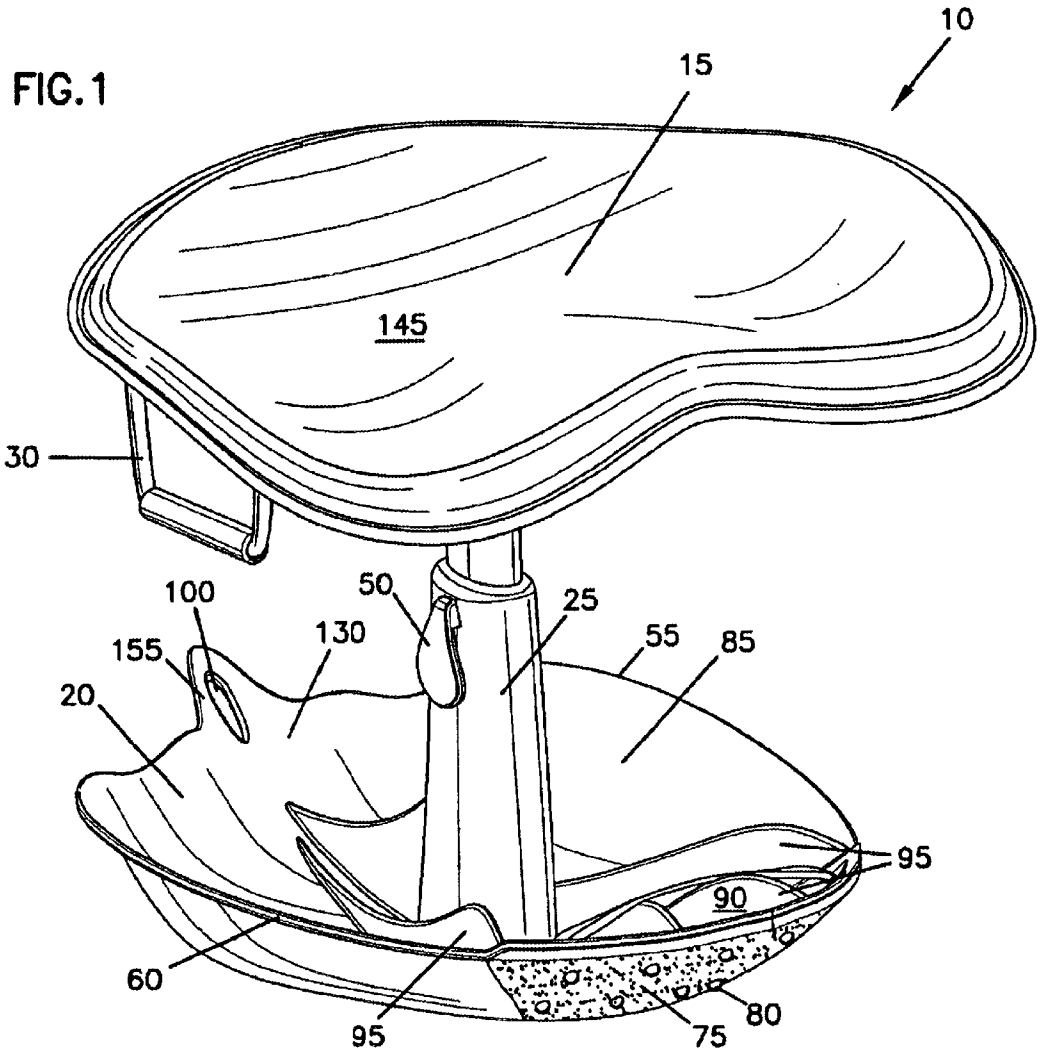
FIG. 1 is a top front perspective view of one embodiment of a gardening stool of the invention.

The front end 115 of the base 20 includes a rounded nose 65 that extends upwards from the bottom surface 70. As shown in FIGS. 5 and 6, the convex curvatures and the concave regions 150 of the bottom surfaces converge and meet at the nose 65. The nose 65 can be a non-slip area 75. The non-slip area 75 can be textured or it can be covered with a non-slip material, such as textured rubber or plastic. The non-slip area 75 can additionally have discrete protrusions 80, as illustrated in FIG. 1. The non-slip area 75 of the nose 65 prevents the stool from slipping out from under the user when the user leans forward and tilts the stool forward. The protrusions 80 can be in the form of bumps, ridges, spikes, etc., and can have any shape that provides additional traction when the stool is tilted forward such that the nose 65 is in contact with the ground.

Figures 2, 3:
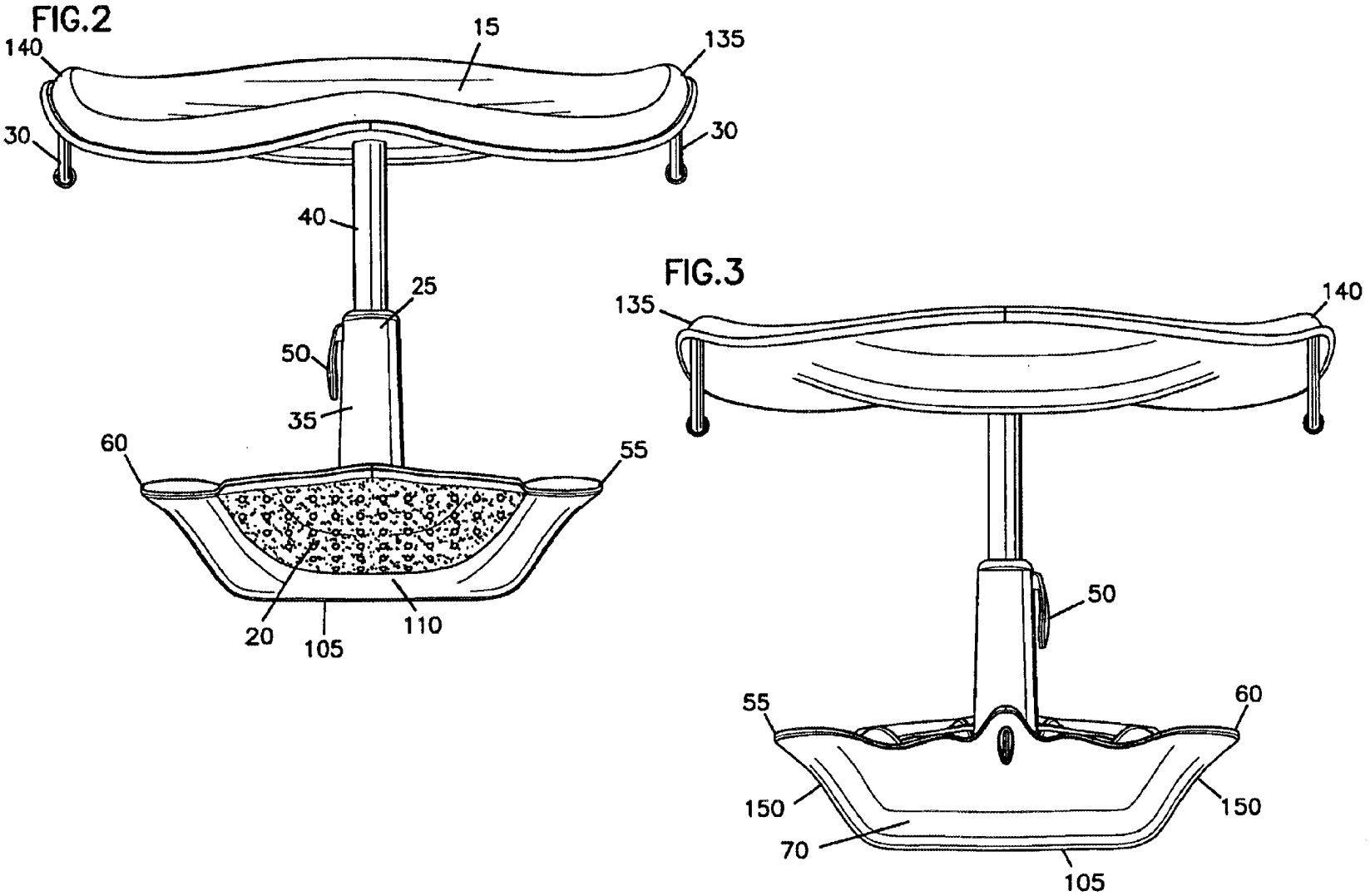
FIG. 2 is a front elevational view of the gardening stool of FIG. 1.
FIG. 3 is a rear elevational view of the gardening stool of FIG. 1.

Referring to FIGS. 3 and 5, the bottom surface 70 of the base 20 includes a stabilization region in the form of a flattened region 105. FIG. 5 shows the flattened region 105 in relation to the post 25 (shown in dashed line). The majority of the flattened region 105 is located rearward of the post 25. Preferably, three-fourths or the entire flattened region 105 is rearward of the post 25. The term flattened region is defined as a region that is generally flatter than the surrounding region. The flattened region may also be defined as a region having a substantially flat portion or even a slightly concave portion.

The flattened region 105 of the base 20, the post 25, and the seat 15 are configured such that the user's center of gravity, when seated upright in the seat 15, is directly over or in vertical alignment with the flattened region 105. Thereby, when the user is seated upright, at least a portion of the flattened region 105 is in contact with the ground surface to provide stability. For example, the flattened region 105 may comprise a slightly concave region wherein the perimeter of the concave region prevents the stool from tipping by providing relatively wide spacing between ground contact areas. Other configurations of stabilization regions (e.g., knobs, protrusions, concave regions) providing relatively widely spaced apart ground contact regions can also be used.

Forward of the flattened region 105, the bottom surface 70 comprises a curved region 110. The curved region 110 is a mesh of the first longitudinal convex curvature and the second transverse convex curvature. The flattened region 105 transitions into the curved region 110 at or near the perimeter of the flattened region. The curved region 110 extends upwards to the nose 65 and allows for pivoting or tilting the stool when the user leans forward or forward and to the left or right.

The upper surface 85 of the base 20 may be upwardly concave. In the embodiment illustrated in FIG. 1, the upper surface 85 has one or more compartments 90 for holding tools. The compartments 90 can be formed by opposing walls 95 forming slots of varying widths. The compartments 90 can include retaining straps (not shown) for securing tools. The retaining straps can be fabric and preferably have elastic properties. The compartments 90 can also include removable covers (not shown).

As shown in FIG. 1, the base 20 of the stool 100 has a hole 100 located at the back 120 for hanging the stool 10. The hole 100 may further be constructed within a base portion 155 extending from the base. Alternatively, the stool can have a loop, hook, or other suitable means for hanging located on the base 20 or seat 15.

In the illustrated embodiment, the seat 15 is contoured with indentations or depressions for a user's legs and buttocks. The seat 15 of the stool has a front end 125 and a back end 130 corresponding to a front and a back of the stool, respectively. The front end 125 and the back 130 of the seat are connected by first and second sides 135, 140. The sides 135, 140 gradually slope upward to form a concave seating area 145. The seating area 145 may have a variety of curves and bowled-shape areas to comfortably seat a user. In the preferred embodiment, the seat 15 is contoured such that the user's center of gravity is located directly over or in vertical alignment with the flattened region 105 of the base 20. In alternative embodiments, the seat 15 can be flat, convex, concave, or any other suitable configuration for supporting a seated user. In the embodiment shown in FIG. 4, the seat 15 has a length L1 that is transverse from the length L2 of the base 20. The seat 15 is elongated from the first side 135 to the second side 140, and is elongated transverse with respect to the longitudinal axis A—A of the base 20. This stool configuration provides multi-directional stability. First, the user is supported along the longitudinal axis A—A by the base length L2 and second, the seat orientation provides stability transverse to the longitudinal axis A—A by opposing placement of the user's legs.

As shown in FIG. 2, the stool may further include handles 30 attached to the first 135 and second 140 sides of the seat 15. The handles 30 can be attached to the underside of the seat as shown in the figures. Alternatively, the handles can be attached at or along the sides 135, 140 of the seat. In another embodiment, the handles can be indentations, ridges, or holes formed in the periphery of the seat. The handles provides the user with a convenient means to carry the gardening stool.

Figure 9:
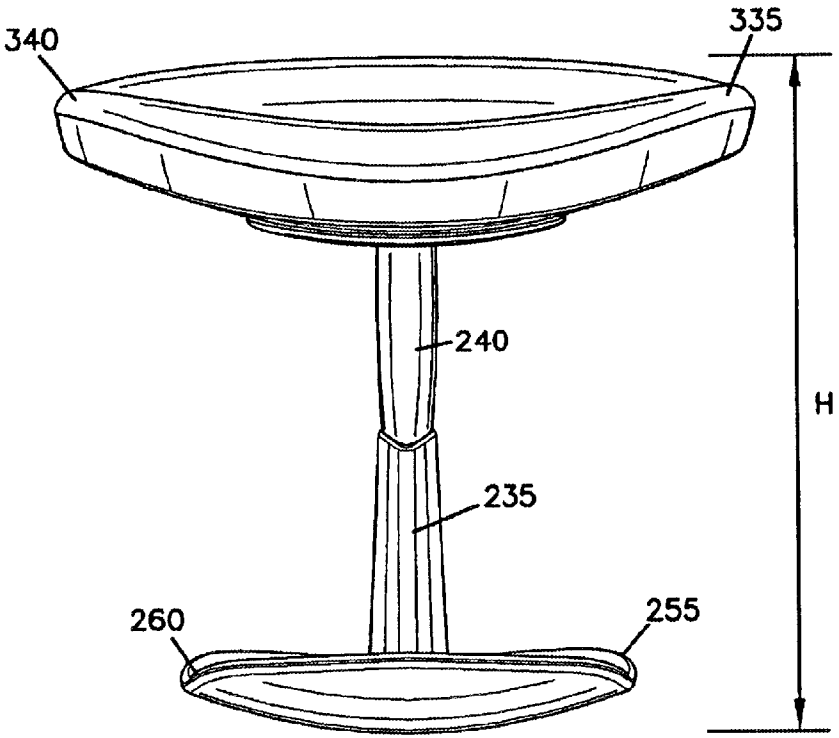
FIG. 9 is a front elevational view of the gardening stool of FIG. 8.
Figure 12:
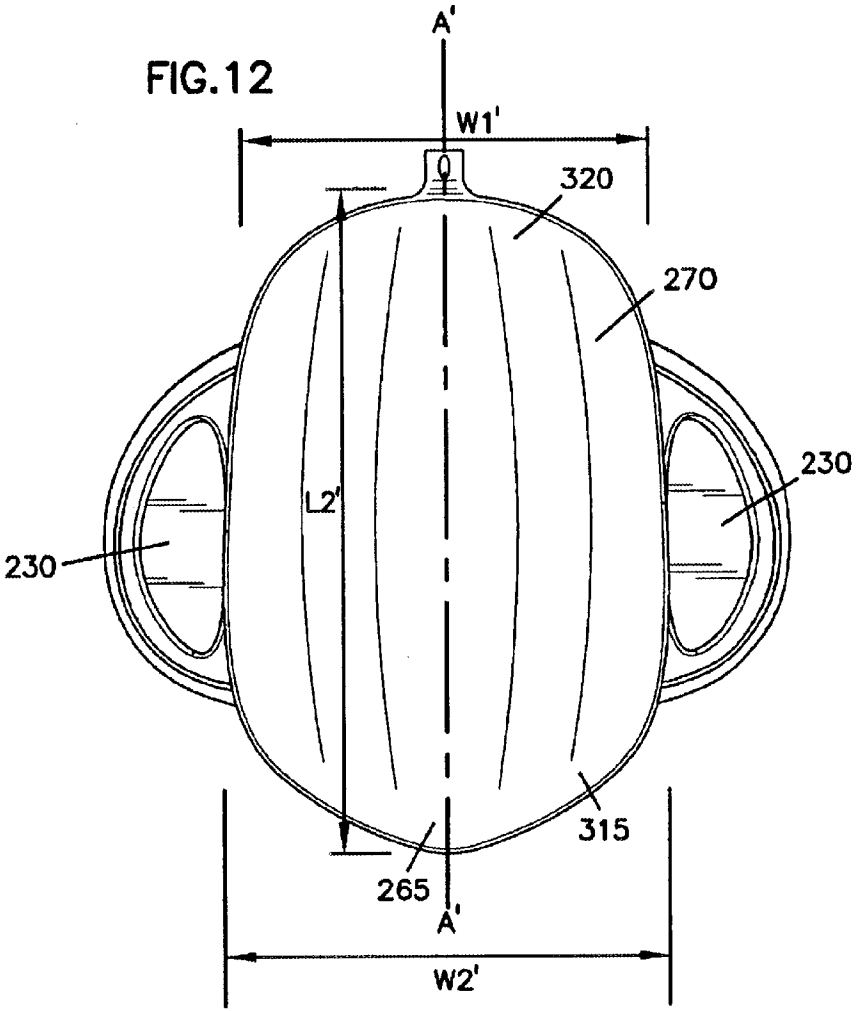
FIG. 12 is a bottom plan view of the gardening stool of FIG. 8.
Figure 11:
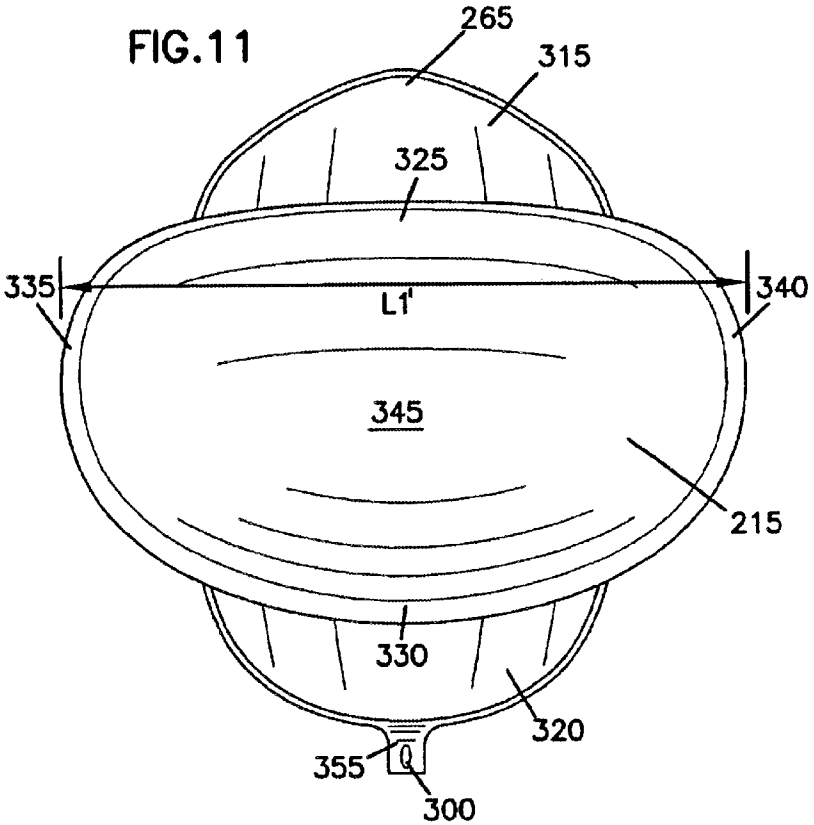
FIG. 11 is a top plan view of the gardening stool of FIG. 8.
Figure 13:
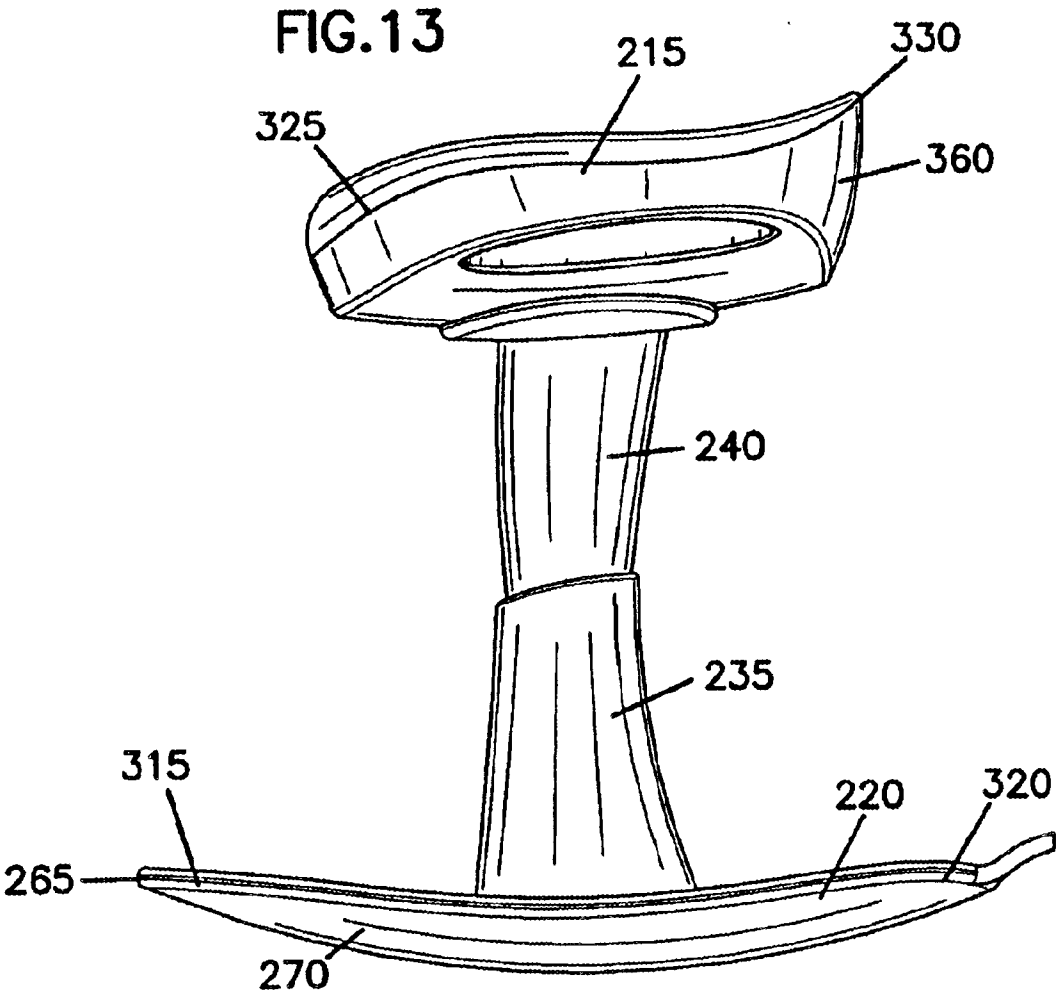
FIG. 13 is a side elevational view of the gardening stool of FIG. 8.

In an alternative embodiment, shown in FIGS. 8–13, the stool 210 includes a seat 215 attached to a base 220 by a post 225. The post 225 connecting the seat 215 and base 220 has two parts. As shown in FIGS. 9 and 13, the post 225 has a lower section 235 and an upper section 240. The upper section 240 is slideably received within an aperture (not shown) of the lower section 235 and stopped by the tapered design of the upper section 240. In other words the upper section 240 is inserted into the lower section 235 to a position at which the cross-sectional area of the upper post section 240 is greater than the cross-section of the aperture of the lower post section. The post 225 can be any shape or size that provides support for the seat 215 and a means of attaching the seat 215 to the base 220. Overall, the stool 210 has a height H from the base 220 to the top of the seat 215. The maximum height is preferably less than 12 inches, more preferably less than 10 inches, and most preferably less than 9 inches. With this height range configuration, the seated user may garden in a kneeling position with added seat support.

Similar to the first embodiment, the base 220 of the stool has a front end 315 and a back end 320 corresponding to a front and a back of the stool, respectively. As shown in FIG. 12, the base 220 is elongated from the front end 315 to the back end 320 along a longitudinal axis A'—A' and has a length L2'. The base 220 has a first width W1' adjacent the back end 320 and a second width W2' adjacent the front end 315. The widths of this embodiment may remain substantially constant, taper slightly from the front end 315 toward the backend 320 as shown, or may also taper in the alternative direction as described in the first embodiment.

The base 220 further comprises a bottom surface 270 and an upper surface 285. The bottom surface 270 defines a first longitudinal convex shape extending from the front end 315 toward the back end 320 (see FIG. 13). The bottom surface 270 also defines a second transverse convex shape extending from the first side 255 to the second side 260 (see FIG. 9). The first and second convex curvatures of the base 70 are configured such that user may tilt, roll, or pivot the stool in any direction while at the same time providing the user seat support.

The front end 315 of the base 220 includes a rounded nose 265 that extends upwards from the bottom surface 270. Although not shown, this nose area 265 may include a non-slip area similar to that shown in the first embodiment.

The upper surface 285 of the base 220 may be upwardly concave. A hole 300 at the back end 320 of the base 220 is provided for hanging the stool 210. The hole 300 may further be constructed within a base portion 355 extending from the base 220. Alternatively, the stool can have a loop, hook, or other suitable means for hanging located on the base 220 or seat 215.

In the illustrated embodiment, the seat 215 is contoured with indentations or depressions for a user's legs and buttocks. The seat 220 of the stool has a front end 325 and a back end 330 corresponding to a front and a back of the stool, respectively. The front end 325 and the back end 330 of the scat are connected by first and second sides 335, 340. The sides 335, 340 gradually slope upward to form a concave seating area 345. In the preferred embodiment as shown in FIG. 13 the seat has a back support 360 defined in the back end 330 of the seat. In alternative embodiments, the seat 15 can be flat, convex, concave, or any other suitable configuration for supporting a seated user. Similar to the previous embodiment, the seat 215 has a length L1' that is transverse from the length L2' of the base 220. The seat 215 is elongated from the first side 335 to the second side 340, and is elongated transverse with respect to the longitudinal axis A'—A' of the base 220.

As shown in FIG. 2, the stool may further include cavities or handles 230. The handles 230 are formed into the seat 215 as shown in the figures. Alternatively, handles can be attached at the sides 335, 340 of the seat or comprise apertures, indentations or ridges formed in the periphery of the seat. The handles provides the user with a convenient means to carry the gardening tool.

In use, a gardener will typically carry the stool to a desired gardening site. The gardener places the seat at a desired location and sits upon the stool seat. Various gardening tools may be place in the base of the stool for convenient access. In the first embodiment, the user's feet are placed on the ground; the user's legs extending from the ground generally at a 90-degree angle while seated in an upright position. In the second embodiment, the user kneels on the ground. The seat is positioned under the user's buttocks for semi-seated support. From the seated or semi-seated position, the user leans or pivots forward and rolls the stool upon its convex base to reach a particular garden spot. Tools are handily reached underneath the stool seat. The stool provides continuous buttock support to the gardener while performing gardening tasks. In essence, the stool follows the physical movements of the gardener while, for example, reaching for and pulling weeds.

Upon completing the gardening task at the particular garden spot, the user may lean or tilt the stool to access a nearby garden spot. The non-slip area on the stool provides the gardener with stable support while reaching to various garden spots. By this, the gardener may tilt the stool to reach areas in the garden that the gardener would otherwise have to stand up and move toward in order to reach. Upon completing all gardening tasks, the gardener may easily store the stool by hanging it in a convenient location.

The foregoing describes numerous embodiments of an invention for a stool for use when gardening. Having described the invention, alternatives and embodiments may occur to one of skill in the art. It is intended that such modifications and equivalents shall be included within the scope of the following claims.

What is claimed is:

1. A stool, comprising:

(a) a seat;

(b) a base having a front end and a back end, said base being elongated from the front end to the back end and defining a longitudinal axis;

(c) a post connecting said seat to said base;

(d) a stabilization structure positioned rearward of the post;

said base including a first contour located forward of said post, said first contour having a first convex curvature in a direction transverse to the longitudinal axis for allowing side to side pivoting;

said base including a second contour extending a direction along the longitudinal axis for allowing front to back pivoting;

said stabilization region configured to stabilize said stool by limiting side to side pivoting when said stool is upright without interfering with forward pivoting, and without limiting side to side pivoting when said stool is pivoted forward.

2. The stool of claim 1, wherein said seat is elongated traversely to the longitudinal axis of said base.

3. The stool of claim 1, wherein said seat is shaped such that a seated user's center of gravity is positioned rearward of said post.

4. The stool of claim 1, wherein said stabilization structure comprises a flattened region.

5. A stool comprising:

a) base having a front and a back corresponding to a front and back of the stool, respectively, wherein the base is elongated from the back to the front alone a longitudinal axis, wherein the base has a convex bottom surface that defines an upwards extending nose at the front of the base;

b) a seat; and c) a post connecting the base and the seat;

d) wherein the base tapers from a first width located rearward of the post to a second, narrower width located forward of the post.

6. The stool of claim 5 wherein the base includes a continuously narrowing taper from the first width to the second, narrower width.

7. A stool comprising:

(a) a base having a width and a length, the length extending from a front end to a back end, the length being greater than the width;

(b) a seat;

(c) a post connected to the base and the seat;

(d) a first contour that extends across the width of the base, the first contour including convex portions on left and right sides of the post; and e) a second contour that extends along the length of the base, the second contour including front and rear convex portions located forward and rearward of the post.

8. The stool of claim 7 wherein the seat has a front and back corresponding to the front end and back end of the base, respectively, and first and second sides adjacent the front and back, wherein the seat is elongated from the first and second sides, wherein the seat is elongated transverse with respect to the length of the base.

9. The stool of claim 8 further comprising handles positioned at the first and second sides of the seat.

10. The stool of claim 8 wherein the seat is contoured.

11. The stool of claim 7 wherein the front end is rounded and extends upwardly.

12. The stool of claim 11 wherein the base includes a non-slip bottom surface at the front end.

13. The stool of claim 12 wherein the non-slip bottom surface of the base at the front end further comprises discrete protrusions.

14. The stool of claim 7 further comprising a hole at the back end of the base for hanging.

15. The stool of claim 7 wherein the width includes a primary width located rearward of the post and a secondary, narrower width located forward of the post, the length of the base being greater than both the primary and secondary, narrower widths of the base.

16. The stool of claim 15 wherein the base tapers from the primary width to the secondary, narrower width.

17. A stool, comprising:

(a) a seat;

(b) a base having a front end and a back end, said base being elongated from the front end to the back end and defining a longitudinal axis;

(c) a support structure connecting said seat to said base;

(d) a stabilization structure;

said base including a first contour having a first convex curvature in a direction transverse to the longitudinal axis for allowing side to side pivoting;

said base including a second contour extending a direction along the longitudinal axis for allowing front to back pivoting;

said stabilization region configured to stabilize said stool by limiting side to side pivoting when said stool is upright without interfering with forward pivoting, and without limiting side to side pivoting when said stool is pivoted forward.

18. The stool of claim 17, wherein said seat is elongated traversely to the longitudinal axis of said base.

19. The stool of claim 17, wherein said stabilization structure comprises a flattened region.

20. A stool comprising:

a) a base having a front and a back corresponding to a front and back of the stool, respectively, wherein the base is elongated from the back to the front along a longitudinal axis, wherein the base has a convex bottom surface that defines an upwards extending nose at the front of the base;

b) a seat; and c) a support structure connecting the base and the seat;

d) wherein the base tapers from a first width located at the back of the base to a second, narrower width located at the front of the base.

21. The stool of claim 20 wherein the base includes a continuously narrowing taper from the first width to the second, narrower width.

22. A stool comprising:

(a) a base having a width and a length, the length extending from a front end to a back end, the length being greater than the width;

(b) a seat;

(c) a support structure connected to the base and the seat;

(d) a first contour that extends across the width of the base, the first contour including convex portions on left and right sides of the base; and e) a second contour that extends along the length of the base, the second contour including front and rear convex portions located at the front end and the back end of the base.

23. The stool of claim 22 wherein the seat has a front and back corresponding to the front end and back end of the base, respectively, and first and second sides adjacent the front and back, wherein the seat is elongated from the first and second sides, wherein the seat is elongated transverse with respect to the length of the base.

24. The stool of claim 23 further comprising handles positioned at the first and second sides of the seat.

25. The stool of claim 23 wherein the seat is contoured.

26. The stool of claim 22 wherein the front end is rounded and extends upwardly.

27. The stool of claim 26 wherein the base includes a non-slip bottom surface at the front end.

28. The stool of claim 27 wherein the non-slip bottom surface of the base at the front end further comprises discrete protrusions.

29. The stool of claim 22 further comprising a hole at the back end of the base for hanging.

30. The stool of claim 22 wherein the width includes a primary width located at the back end of the base and a secondary, narrower width located at the front end of the base, the length of the base being greater than both the primary and secondary, narrower widths of the base.

31. The stool of claim 30 wherein the base tapers from the primary width to the secondary, narrower width.

* * * * *